US010584617B2

(12) United States Patent
Weber

(10) Patent No.: US 10,584,617 B2
(45) Date of Patent: Mar. 10, 2020

(54) CAMSHAFT CENTERING IN THE SPLIT ROTOR OF A HYDRAULIC CAMSHAFT ADJUSTER

(71) Applicant: Schaeffler Technologies AG & Co. KG, Herzogenaurach (DE)

(72) Inventor: Juergen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 15/989,445

(22) Filed: May 25, 2018

(65) Prior Publication Data

US 2018/0274399 A1 Sep. 27, 2018

Related U.S. Application Data

(63) Continuation of application No. 15/104,803, filed as application No. PCT/DE2014/200584 on Oct. 22, 2014, now Pat. No. 10,094,251.

(30) Foreign Application Priority Data

Dec. 18, 2013 (DE) ..... 10 2013 226 445

(51) Int. Cl.
*F01L 1/344* (2006.01)
*B22F 5/10* (2006.01)

(52) U.S. Cl.
CPC ..... *F01L 1/3442* (2013.01); *B22F 5/106* (2013.01); *F01L 2001/3445* (2013.01); *F01L 2001/34423* (2013.01); *F01L 2101/00* (2013.01); *F01L 2103/00* (2013.01); *F01L 2820/01* (2013.01)

(58) Field of Classification Search
CPC ..... F01L 2001/34423; F01L 2001/3445
USPC ..... 123/90.17
See application file for complete search history.

(56) References Cited

U.S. PATENT DOCUMENTS

| | | | |
|---|---|---|---|
| 6,517,601 | B1 | 2/2003 | Masuda et al. |
| 7,640,902 | B2 | 1/2010 | Knecht et al. |
| 8,327,813 | B2 | 12/2012 | Tada et al. |
| 8,490,589 | B2 | 7/2013 | Arnold |

(Continued)

FOREIGN PATENT DOCUMENTS

| | | | |
|---|---|---|---|
| DE | 60017658 | T2 | 12/2005 |
| DE | 102008028640 | A1 | 12/2009 |

(Continued)

*Primary Examiner* — Jorge L Leon, Jr.
(74) *Attorney, Agent, or Firm* — Davidson, Davidson & Kappel, LLC

(57) ABSTRACT

A camshaft adjuster (1) is provided for an internal combustion engine of the vane cell type, having a stator (2) and a rotor (3) which can be rotated relative to the stator (2) and consists of a plurality of rotor parts (4, 5, 6) which are connected to one another, wherein the rotor (3) can be connected fixedly to a camshaft (7) of the internal combustion engine so as to rotate with it, and a first rotor part (4) is configured in such a way that the camshaft (7) is supported with contact on the first rotor part (4) in an operating state, wherein the first rotor part (4) is produced by a sintering process, and at least one first supporting surface (9), supporting the camshaft (7), of the first rotor part (4) is set geometrically by a chipless machining operation, and to a method for producing a rotor (3) for a camshaft adjuster (1) of this type.

15 Claims, 4 Drawing Sheets

(56) References Cited

U.S. PATENT DOCUMENTS

| | | | | |
|---|---|---|---|---|
| 8,550,046 | B2 | 10/2013 | Terfloth et al. | |
| 8,561,582 | B2 | 10/2013 | Deneri | |
| 8,578,899 | B2 | 11/2013 | Ottersbach et al. | |
| 9,284,862 | B2 | 3/2016 | Frey | |
| 2006/0137635 | A1* | 6/2006 | Hayashi | F01L 1/022 123/90.17 |
| 2006/0278189 | A1* | 12/2006 | Knecht | F01L 1/3442 123/90.17 |
| 2011/0126785 | A1* | 6/2011 | Terfloth | F01L 1/022 123/90.15 |
| 2012/0103288 | A1* | 5/2012 | Deneri | F01L 1/3442 123/90.15 |
| 2012/0132160 | A1* | 5/2012 | Malen | B22F 5/008 123/90.15 |
| 2012/0222638 | A1* | 9/2012 | Arnold | F01L 1/3442 123/90.17 |
| 2013/0186356 | A1* | 7/2013 | Schelter | F01L 1/46 123/90.15 |
| 2013/0199479 | A1* | 8/2013 | Ottersbach | F01L 1/3442 123/90.17 |
| 2013/0213331 | A1* | 8/2013 | Landersdorfer | F01L 1/053 123/90.17 |
| 2013/0247855 | A1* | 9/2013 | Adachi | F01L 1/3442 123/90.15 |
| 2014/0238325 | A1* | 8/2014 | Frey | F01L 1/3442 123/90.17 |
| 2015/0013636 | A1 | 1/2015 | Boese et al. | |
| 2015/0096513 | A1* | 4/2015 | Noguchi | F01L 1/356 123/90.17 |

FOREIGN PATENT DOCUMENTS

| | | | |
|---|---|---|---|
| DE | 102008032949 | A1 | 1/2010 |
| DE | 102010014341 | A1 | 10/2010 |
| DE | 102009031934 | A1 | 1/2011 |
| DE | 102009053600 | A1 | 5/2011 |
| DE | 102010024198 | A1 | 12/2011 |
| DE | 102011117856 | A1 | 5/2013 |
| DE | 102012102022 | A1 | 9/2013 |
| DE | 102012206338 | A1 | 10/2013 |
| EP | 1731722 | A1 | 12/2006 |
| WO | 2009152987 | A1 | 12/2009 |
| WO | 2010128976 | A1 | 11/2010 |

* cited by examiner

CAMSHAFT CENTERING IN THE SPLIT ROTOR OF A HYDRAULIC CAMSHAFT ADJUSTER

This is a continuation of U.S. patent application Ser. No. 15/104,803, filed Jun. 15, 2016 which is a national phase application of PCT/DE2014/200584 filed Oct. 22, 2014, which claims the benefit of German Patent Application DE 10 2013 226 445.3, filed Dec. 18, 2013, all three applications being hereby incorporated by reference herein.

The present invention relates to a (hydraulic) camshaft adjuster for an internal combustion engine, such as a gasoline engine or a diesel engine of a motor vehicle such as a passenger vehicle, truck, bus, or agricultural vehicle. The camshaft adjuster has a vane cell type design, and accordingly includes a stator, and a rotor which is rotatable relative to the stator and made up of multiple interconnected rotor parts, the rotor being connectable in a rotatably fixed manner to a camshaft of the internal combustion engine, and a first rotor part being designed in such a way that in an operating state the camshaft is supported while resting against the first rotor part, and the first rotor part is manufactured with the aid of a sintering process. Moreover, the present invention relates to a method for manufacturing a rotor for such a camshaft adjuster.

BACKGROUND

Various designs of camshaft adjusters and of rotors used in them are already known from the prior art. For example, Published Unexamined German Patent Application DE 10 2009 053 600 A1 provides a rotor, in particular for a camshaft adjuster, which includes a rotor base body having a hub part with a central oil supply line, at least one vane which is radially situated on the hub part, and oil channels which extend through the hub part on both sides of each vane and which are fluidically connected to the central oil supply line, the rotor base body being divided along a parting line and including two base body parts.

Furthermore, Published Unexamined German Patent Application DE 10 2009 031 934 A1 provides a camshaft adjuster which includes a stator and a rotor, situated in the stator, which includes vanes, each of which is situated in a chamber formed between the stator and the rotor. The vanes divide their respective chamber into two subchambers, pressure oil being suppliable to and dischargeable from each subchamber via oil channels, so that the pressure oil may exert a torque on the rotor, as the result of which the rotor is rotatable, and therefore a camshaft adjustment is adjustable. The rotor is made of a metallic base structure which includes a plastic liner, axially adjacent thereto, in which at least one of the oil channels is formed.

WO 2010/128976 A1 provides an assembly made up of multiple components, including a first powder metal component which is connected to a second powder metal component, each of the powder metal components having an engagement surface structure at a connection point between the components, which cooperate with one another. At least one of the two powder metal components includes at least one surface which is machined before the two components are joined together, the two components being joined together with the aid of an adhesive.

Furthermore, Published Unexamined German Patent Application DE 10 2011 117 856 A1 provides multipart joined rotors in hydraulic camshaft adjusters having joint sealing profiles, and associated methods for manufacturing the rotors.

In addition, WO 2009/152987 A1 provides a hydraulic camshaft adjuster for a camshaft of an internal combustion engine, including an outer body which is drivable with the aid of a crankshaft of the internal combustion engine and which includes at least one hydraulic chamber, and an inner body, situated inside the outer body, which is fixedly connectable to the camshaft and includes at least one pivoting vane which extends into the hydraulic chamber in the radial direction. In addition, the inner body is assembled at least from a first and a second element, each of the two elements at mutually facing front sides having at least a geometry which together with the respective other element forms the oil supply line and oil discharge line of the inner part.

DE 10 2008 028 640 A1, another Published Unexamined German Patent Application, once again provides a hydraulic camshaft adjuster having a function and design according to the camshaft adjustment mechanism described in WO 2009/152987 A1.

In addition, EP 1 731 722 A1 provides a camshaft adjuster which includes a swivel motor with reduced leakage, the rotor being provided as a composite system made up of at least two components, one of the components being a cover.

Furthermore, a method is known from the prior art for manufacturing a three-dimensional cam (see DE 600 17 658 T2).

DE 10 2010 024 198 A1 provides a friction disk and a camshaft adjuster system.

SUMMARY OF THE INVENTION

However, in these known camshaft adjusters, the installed rotors in the support area (at the supporting surface) always require a mechanical finishing operation in order to adjust the supporting surface, which is connected to the camshaft in the operating state, to the desired dimensions/the desired geometry (with preferably low tolerances). The section in the rotor which is provided for the camshaft centering, the undercut in the rotor for the camshaft edge, and the undercut in the rotor for fixing an appropriate diamond wheel must be mechanically finished. As a result, the manufacturing process is relatively complicated, which in turn increases the manufacturing costs.

It is an object of the present invention to eliminate the disadvantages known from the prior art, and to manufacture a rotor of the camshaft adjuster, having the desired geometric and material properties, in preferably few machining steps.

This is achieved according to the present invention in that at least one first supporting surface of the first rotor part which supports the camshaft is set/formed/calibrated/adjusted with the aid of a non-cutting machining operation, the at least one supporting surface being geometrically adjusted with the aid of a calibration step of the sintering process via which the first rotor part is also manufactured, or a punching process. With the aid of such a calibration step, the first rotor part is compacted in the area of the supporting surface, i.e., on/near the surface. A calibration/calibration step (or a geometric adjustment) of the sintered parts is understood to mean a local re-compaction of sintered pore surfaces, with the aim of compensating for distortions in the sintering process and increasing the dimensional accuracy as well as the surface density, surface hardness, surface quality of the relevant functional surfaces (supporting surface) or functional elements, and the strength of the component. The sintered part (first rotor part) is re-compacted in a calibration tool similar to a pressing tool. For wall thicknesses of approximately 3 mm, the degree of pressing is usually several tenths of a millimeter (approximately 0.1-0.3 mm); i.e., the local overpressing of the sintered surfaces in the calibration step may be up to 12% maximum of the wall thickness. Depending on the density and material of the rotor parts, improvements in the dimensional accuracy by approximately two tolerance classes may be achieved (for example, from ISO/IT 8-9 to ISO/IT 6-7 for Sint-D11 according to DI30910-4). Depending on the pore density and pore size in the starting material, the compaction process (deformation in the pressing tool or rolling), and the degree of deformation, the re-compaction in the calibration step may be increased by up to 100% maximum of the possible spatial filling. The calibrated surfaces are thus virtually pore-free, and the material density in the surface region is essentially comparable to the density of the solid base material (for steel, for example, approximately 7.8 g/cm$^3$).

Therefore, in the calibration step, compaction of the entire part/rotor part to be manufactured does not take place, as in the customary sintering process, but, rather, takes place only at the surface. The material is thus compacted at the surface/the supporting surface in order to eliminate the porosity there by up to 100%. In the process, the dimensional tolerances decrease to well below 2%. The manufacturing complexity and the manufacturing costs are further reduced due to the calibration in the sintering process itself or in a separate punching process.

As a result, in particular the most critical component of the rotor with regard to the dimensional tolerances is manufacturable almost completely by a sintering process/a sintering method. The adjustment/setting/formation/calibration of the geometric dimensions of the supporting surface is carried out with the aid of a non-cutting machining operation. In particular, cost-intensive cutting machining steps using tools that wear down quickly are thus avoided, so that the rotor is manufacturable much more cost-effectively, and mechanical finishing may be dispensed with.

It is thus advantageous when the at least one first supporting surface is/forms an inner circumferential surface of the first rotor part which supports the camshaft in the radial direction, the diameter of the inner circumferential surface of the first rotor part preferably being geometrically adjusted/formed/calibrated. Exact radial positioning of the rotor relative to the camshaft is thus possible.

In addition, a particularly space-saving design of the rotor is conceivable when the multiple rotor parts of the rotor are internested in the axial direction or in the radial direction.

It is also advantageous when the rotor includes a second rotor part which supports the camshaft in the axial direction, the first rotor part being connected to the second rotor part in a rotatably fixed manner. Radial as well as axial positioning of the rotor relative to the camshaft, for example the front side of the camshaft, is thus possible.

In this regard, it is also advantageous when the second rotor part is likewise manufactured with the aid of a sintering process, at least one second supporting surface of the second rotor part being geometrically adjusted/formed/calibrated in this sintering process with the aid of a calibration step, or in a punching process. The other, second rotor part is thus geometrically designable/manufacturable in a particularly precise manner.

In addition, it is particularly advantageous when the second rotor part is geometrically adjusted/calibrated/formed with regard to its width and/or planarity. Particularly precise adjustment of the second supporting surface facing the camshaft as well as the side surface of the second rotor part facing away from this second supporting surface is then possible.

Furthermore, it is also advantageous when a diamond wheel for increasing the friction force is accommodated between the first rotor part and the camshaft and/or between the first and the second rotor part, at the at least one first supporting surface and/or the at least one second supporting surface. The contact force between the rotor and the camshaft during operation may be further increased in this way.

In this regard, it is particularly advantageous when the diamond wheel is inserted into a recess in the first rotor part and/or (into a recess) in the second rotor part. The diamond wheel may thus be integrated in a particularly space-saving manner, in particular the axial dimensions remaining unchanged.

This recess may advantageously be geometrically formed with the aid of a calibration step of the sintering process or a punching process, in that the particular rotor part is compacted at the surface only in the area of this recess, thus forming a geometric recess. It is thus possible to ensure particularly exact dimensions of the recess, and thus, in particular to install thin diamond wheels.

Moreover, the present invention relates to a method for manufacturing a rotor for a camshaft adjuster according to one of the specific embodiments mentioned above, the method including (at least) the following steps:

a) sintering a first rotor part and b) calibrating at least one first supporting surface of the first rotor part, which is provided for supporting a camshaft of an internal combustion engine, the at least one first supporting surface being geometrically adjusted by non-cutting machining (in the calibration step).

A method/manufacturing method may thus be designed in a particularly efficient manner. In turn, it is particularly advantageous in this regard when the non-cutting machining step/calibration step includes punching or a sintering operation, as the result of which the first rotor part is compressed/compacted at the surface. The compaction is generally approximately 90% during the sintering for obtaining the green compact. Re-compaction is then carried out in an oven, ultimately resulting in a compaction of approximately 98%, beyond a tolerance of approximately 2% at a density of approximately 6.8 to 7.1 g/cm$^3$/approximately 7 g/cm$^3$. This is followed by the calibration step, in which the surface of the first rotor part is compacted, in the present case in the area of the first supporting surface. A material having a higher surface density is thus produced, in which almost 100% elimination of porosity is possible. The local hardness at this supporting surface as well as the geometric dimensions are significantly improved in this way.

BRIEF DESCRIPTION OF THE INVENTION

The present invention is now explained below with reference to several specific embodiments in the figures.

Figure 10:
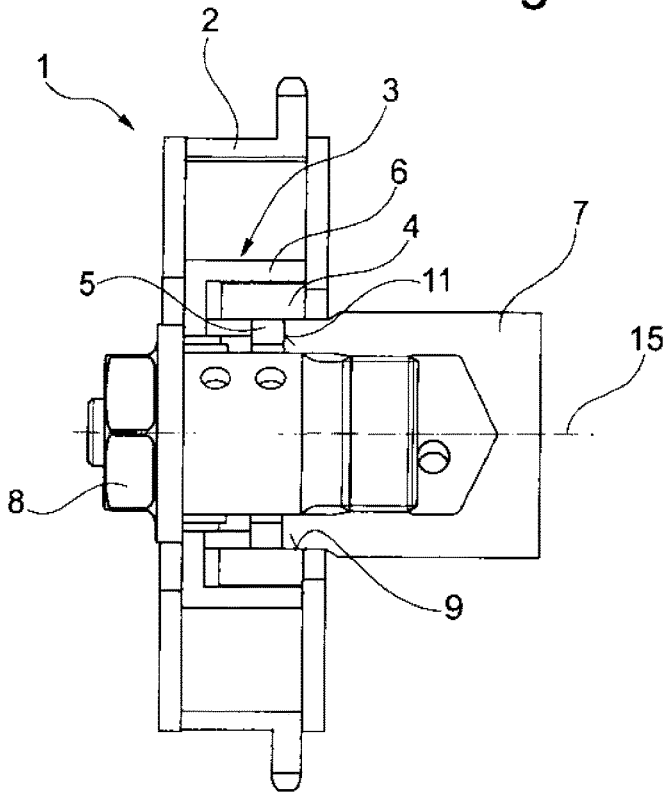
Figure 11:
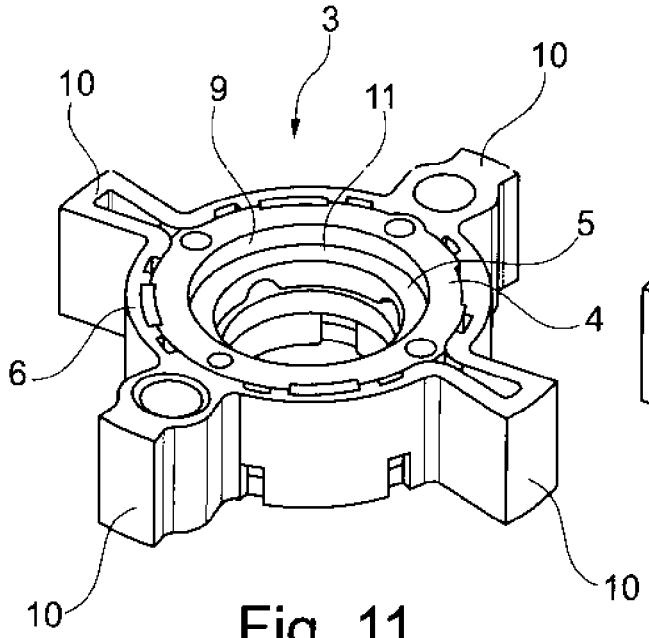
Figure 12:
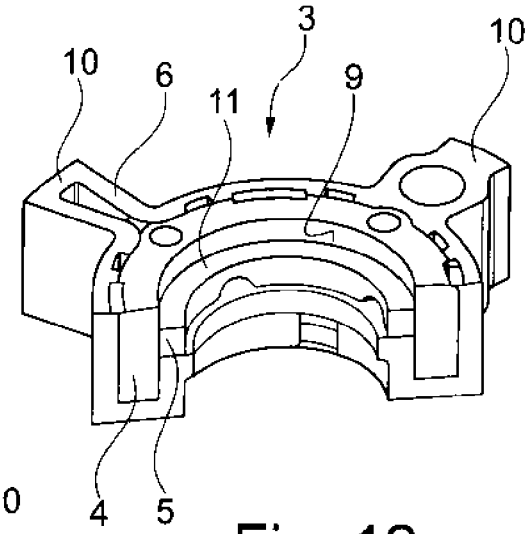
Figure 13:
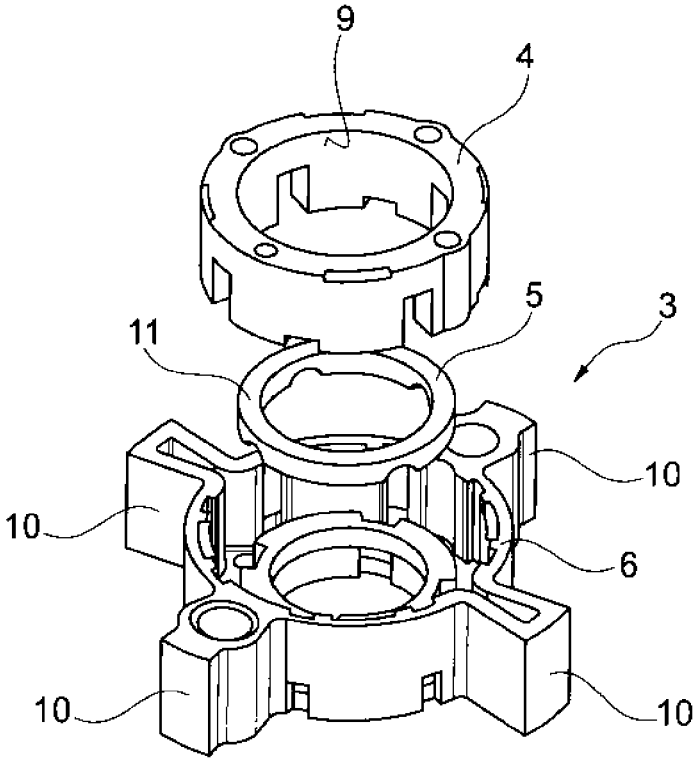

FIG. 10 shows a longitudinal section of a camshaft adjuster according to the present invention according to a further, third specific embodiment, the camshaft adjuster being sectioned along a plane in which the rotation axis of the camshaft/the camshaft adjuster also extends, and once again already being installed on a camshaft, the rotor having a radially nested design according to the onion skin principle;

FIG. 11 shows an isometric view of a radially nested rotor installed in the specific embodiment according to FIG. 10;

FIG. 12 shows an isometric view of a split/halved rotor according to FIG. 11, once again the configuration of the various rotor parts relative to one another in the illustrated parting plane being apparent; and FIG. 13 shows an isometric exploded view of the rotor according to FIGS. 11 and 12, in particular the configuration of the various rotor parts being elucidated here.

The figures are merely schematic, and are used only for an understanding of the present invention. Identical elements are provided with the same reference numerals.

DETAILED DESCRIPTION

Figure 1:
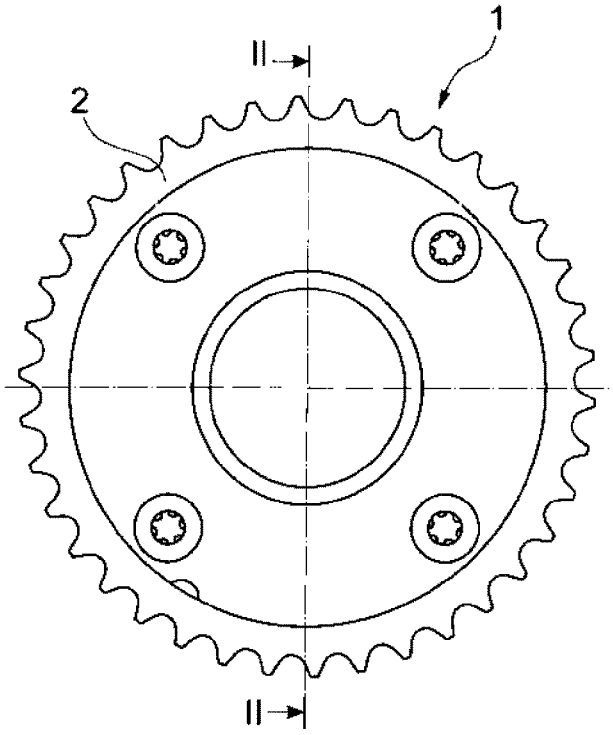
FIG. 1 shows a front view of a camshaft adjuster according to the present invention according to a first specific embodiment, the camshaft adjuster being illustrated in the installed state on the camshaft, viewed from a side facing away from the camshaft in the operating state.
Figure 2:
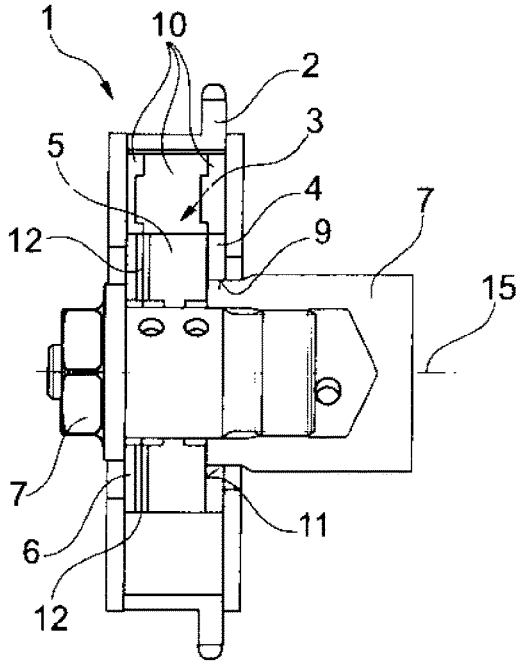
FIG. 2 shows a longitudinal section along the section line denoted by II-II in FIG. 1, extending through the rotation axis of the camshaft adjuster/the camshaft.

The various specific embodiments, as illustrated in conjunction with FIGS. 1 through 13, always represent a hydraulic camshaft adjuster 1 according to the present invention for an internal combustion engine (gasoline or diesel engine) of a motor vehicle such as a passenger vehicle, truck, bus, or agricultural vehicle, camshaft adjuster 1 being designed according to the vane cell type/vane cell principle. According to this vane cell design, camshaft adjuster 1 includes a stator 2, and a rotor 3 which is rotatable relative to stator 2 and made up of multiple interconnected rotor parts 4, 5, and 6. Rotor 3 is rotatably supported within stator 2. In an operating state as also illustrated in FIG. 2, rotor 3 is connected (in a rotatably fixed manner) to a camshaft 7 of the internal combustion engine. For this purpose, a fastening means 8 is used which centrally passes into rotor 3/through rotor 3, and which on the one hand rests firmly against one of rotor parts 4 through 6, and on the other hand is fixedly connected to camshaft 7.

Fastening means 8 is designed as a central valve/central valve screw which is designed not only for fastening rotor 3 at an end area of camshaft 7, but also for introducing and discharging a supply of pressure fluid, which effectuates displacement of camshaft adjuster 1, into/out of camshaft adjuster 1. Stator 2 in turn is coupled in a rotatably fixed manner to a crankshaft of the internal combustion engine, preferably with the aid of a traction drive, namely, a chain drive, or alternatively, with the aid of a belt drive. The valve opening times of the internal combustion engine may thus be adjusted as a function of the rotational position between stator 2 and rotor 3. In addition, at least one first rotor part 4 of rotor 3 is designed in such a way that in the operating state it supports camshaft 7 in the radial direction.

First rotor part 4 is manufactured with the aid of a sintering process, in addition at least one first supporting surface 9 of first rotor part 4 which supports camshaft 7 (in the radial or in the axial direction) being geometrically adjusted/calibrated with the aid of a non-cutting machining operation.

Figure 3:
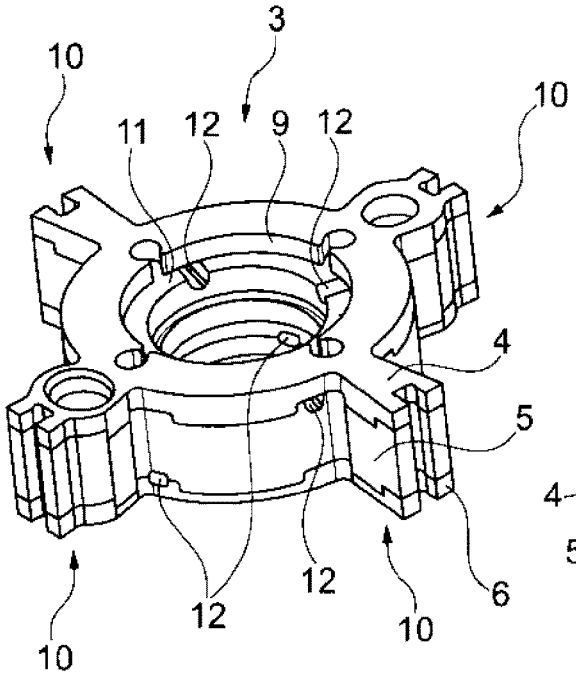
FIG. 3 shows an isometric view of a multipart rotor used in the camshaft adjuster according to FIGS. 1 and 2, the rotor having a sandwich design (multiple axially nested rotor parts)
Figure 4:
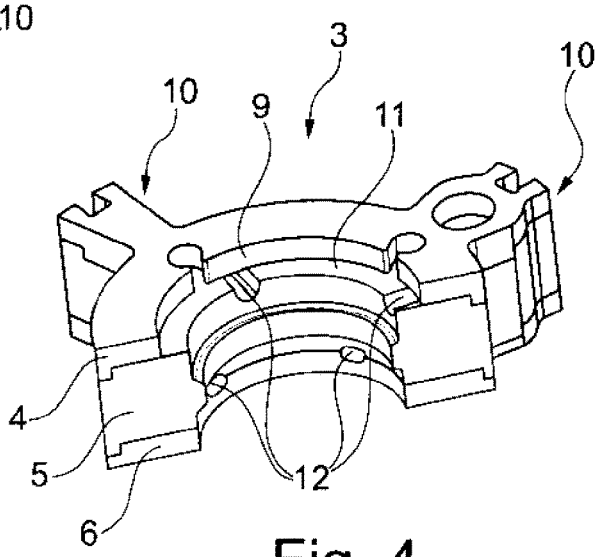
FIG. 4 shows an isometric view of the multipart rotor according to FIG. 3, the rotor being sectioned/halved, and in particular the contact of the various rotor parts with one another in the illustrated parting plane being depicted.

As is further clearly apparent in FIGS. 3 and 4, the rotor has a three-part design, these three rotor parts 4 through 6, referred to below as first rotor part 4, second rotor part 5, and third rotor part 6, being situated next to one another (nested) in the axial direction. Rotor 3 thus has axial nesting.

According to the vane cell design, rotor 3 forms multiple vanes 10 for providing vane cells. These vanes 10 protrude outwardly in the radial direction from an outer circumferential surface of rotor 3, and protrude into stator 2. Each vane 10 protrudes into a separate chamber/working chamber formed in stator 2, each of the chambers being formed at stator 2 with the aid of projections which extend in the direction of rotor 3. In turn, vanes 10 thus divide the chambers of stator 2 into two working subchambers, which may be filled with a pressure fluid and acted on by pressure in alternation in order to adjust the rotary position of rotor 3 relative to stator 2.

In the first specific embodiment, as illustrated particularly well in FIG. 2, first supporting surface 9 is designed as an inner circumferential surface of essentially disk-shaped first rotor part 4. The geometric adjustment takes place via a calibration/a calibration step. This calibration step may be a direct part of the sintering process in which first rotor part 4 is manufactured, or alternatively may be carried out as a punching process.

The calibration step (or a geometric adjustment) is understood to mean a local re-compaction of sintered pore surfaces, with the aim of compensating for distortions in the sintering process and increasing the dimensional accuracy as well as the surface density, surface hardness, surface quality of the relevant functional surfaces (supporting surface) or functional elements, and the strength of the component. The sintered part (first rotor part 4) is re-compacted in a calibration tool similar to a pressing tool. For wall thicknesses of approximately 3 mm, the degree of pressing is usually several tenths of a millimeter (approximately 0.1-0.3 mm); i.e., the local overpressing of the sintered surfaces in the calibration step may be up to 12% maximum of the wall thickness. Depending on the density and material of the rotor parts, improvements in the dimensional accuracy by approximately two tolerance classes may be achieved (for example, from ISO/IT 8-9 to ISO/IT 6-7 for Sint-D11 according to DI30910-4). Depending on the pore density and pore size in the starting material, the compaction process (deformation in the pressing tool or rolling), and the degree of deformation, the re-compaction in the calibration step may be increased by up to 100% maximum of the possible spatial filling. The calibrated surfaces are thus virtually pore-free, and the material density in the surface region is essentially comparable to the density of the solid base material (for steel, for example, approximately 7.8 g/cm$^3$).

Due to the calibration, compaction of the surface in the area of first supporting surface 9 is thus achieved, as the result of which the porosity in the surface layer at first supporting surface 9 is greatly reduced (to virtually 0% porosity). It is thus possible to initially manufacture first rotor part 4 with the aid of a sintering process (production of the green compact). A subsequent compaction of approximately 98% at a density of 6.8 to 7.1 g/cm$^3$/approximately 7 g/cm$^3$ via the calibration step allows first rotor part 4 to be geometrically adjusted to the desired dimensions. First rotor part 4 is thus geometrically adjusted/calibrated at its inner circumferential surface (in particular the diameter of the inner circumferential surface is thus geometrically adjusted).

A second rotor part 5 having an essentially ring-shaped design rests against first rotor part 4. Second rotor part 5 adjoins first rotor part 4 in the axial direction and is connected thereto in a rotatably fixed manner. Second rotor part 5 forms a second supporting surface 11 for the axial support of camshaft 7, whereas first supporting surface 9 supports camshaft 7 in the radial direction. This second supporting surface 11, the same as first supporting surface 9, is also geometrically adjusted with the aid of a calibration step. The geometric adjustment of second rotor part 5 takes place in the same way as in the above-described calibration step on first rotor part 4. Second rotor part 5 is also manufactured by sintering/is sintered. The calibration step is once again a direct part of the sintering process, but alternatively may be carried out as a punching process. Thus, a calibration of second supporting surface 11 of second rotor part 5, designed as an axial front side/front surface, at the same time results in a calibration of the width of second rotor part 5. At the same time, the planarity of second supporting surface 11 extending along the circumference is also adjusted by the calibration process.

A third rotor part 6 is in turn connected to second rotor part 5 in a rotatably fixed manner on a side facing away from first rotor part 4. Third rotor part 6 rests against second rotor part 5 in the axial direction, thus allowing the axial nesting of rotor 3. As is clearly apparent in FIGS. 3 and 4, the (four) vanes 10 of rotor 3 are each formed by partial vanes of respective rotor parts 4 through 6.

Figure 5:
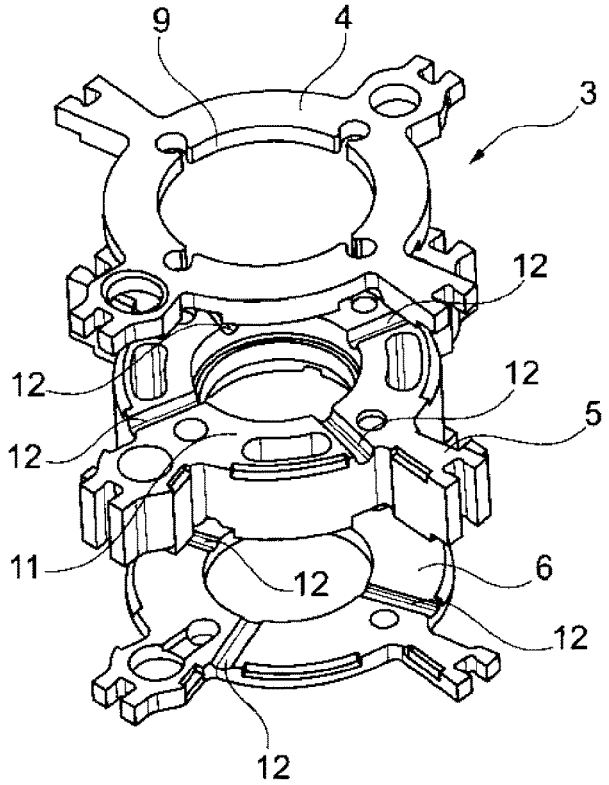
FIG. 5 shows an isometric exploded view of the multipart rotor illustrated in FIG. 3, in particular the configuration of the oil channels introduced into the particular rotor parts being apparent.
Figure 7:
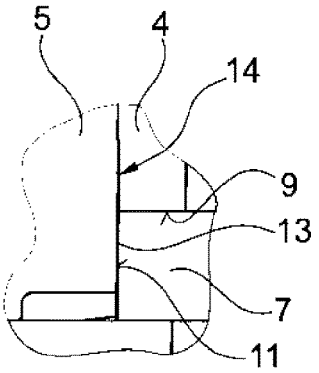
FIG. 7 shows a detailed view of the area in FIG. 6 denoted by VII, in particular the configuration of a diamond wheel which intensifies the contact force between a camshaft and the rotor parts being apparent.

As is also clearly apparent in conjunction with FIG. 5, multiple fluid-conducting channels 12 designed as oil channels are also introduced into rotor 3, which in the operating state conduct pressure fluid, such as oil, in the radial direction from central fastening means 8 into the particular working subchambers (between rotor 3 and stator 2) and conduct the pressure fluid out of same.

Figure 6:
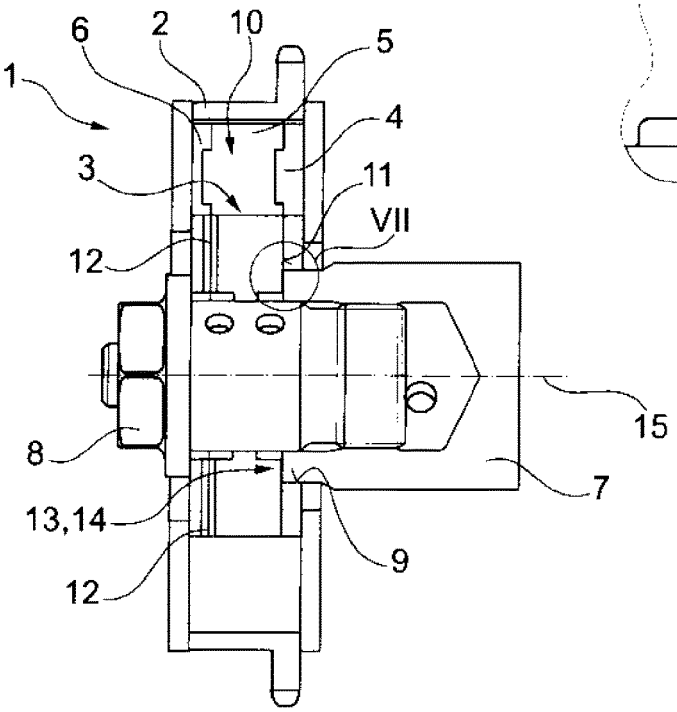
FIG. 6 shows a longitudinal section of a camshaft adjuster according to the present invention according to a further, second specific embodiment, the camshaft adjuster being illustrated in the installed state on the camshaft and being sectioned along a plane in which the rotation axis of the camshaft adjuster/the camshaft also extends.

In conjunction with FIG. 6, another specific embodiment of camshaft adjuster 1 is illustrated, camshaft adjuster 1 in principle being designed as camshaft adjuster 1 according to FIGS. 1 through 5, and in particular rotor 3 also being designed and manufactured according to the first specific embodiment. A significant difference is that in this second specific embodiment, a diamond wheel 13 which intensifies the contact between camshaft 7 and second rotor part 5 is present.

This diamond wheel 13 has a hard diamond layer on its axial front surfaces which presses into the front side of camshaft 7 and into second supporting surface 11 for increasing the support force/contact force between camshaft 7 and second supporting surface 11, into the material of the two components. As is also particularly clearly apparent in FIG. 7, diamond wheel 13 is at least partially captively held in the radial direction in a recess 14 (designable as an indentation, undercut, or relief) in first rotor part 4. Recess 14 is introduced into the front surface of first rotor part 4, facing second rotor part 5. The recess preferably extends along the circumference of rotor 3. Diamond wheel 13 is accommodated only in a radially outer section in recess 14, whereas it extends radially further inwardly into the contact area between the front side of camshaft 7 and second supporting surface 11. In this area, in the operating state contact occurs in each case between camshaft 7 and diamond wheel 13 on a first axial side, and between diamond wheel 13 and second supporting surface 11 on a second axial side facing away from the first axial side. The width of recess 14 corresponds to the width/thickness of diamond wheel 13, and in the installed position corresponds to the extension in the axial direction (i.e., in the direction along rotation axis 15 of camshaft 7/camshaft adjuster 1). Diamond wheel 13 is thus also used at the same time as a means for intensifying the contact force between first rotor part 4 and second rotor part 5.

Recess 14 is once again preferably geometrically adjusted/formed with the aid of a calibration step. The geometric adjustment of first rotor part 4 in the area of recess 14 takes place once again via the calibration step, as described in conjunction with the adjustment of first rotor part 4 in the first specific embodiment. The calibration step is once again a step in a sintering process or a punching process, as the result of which the surface of first rotor part 4 is compacted in the area of recess 14, namely, by the width/thickness of diamond wheel 13.

Figure 8:
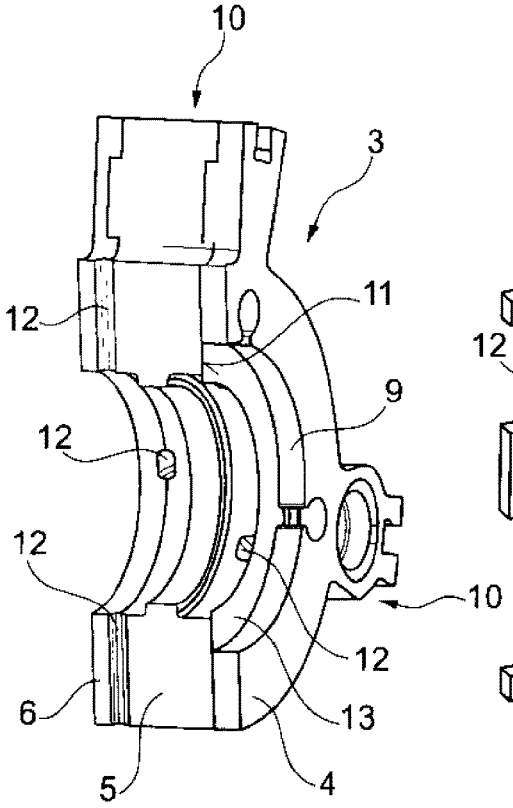
FIG. 8 shows an isometric view of a split/halved rotor as used in the camshaft adjuster according to the specific embodiment from FIG. 6, once again the sandwich-like nested rotor being apparent in the illustrated parting plane.
Figure 9:
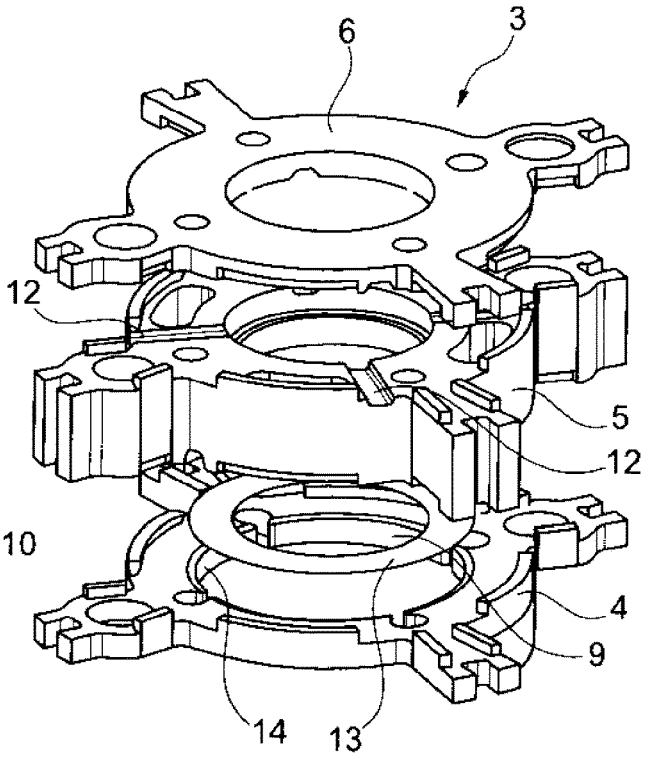
FIG. 9 shows an isometric exploded view of the rotor as used in the specific embodiment of the camshaft adjuster according to FIG. 6, in particular the positioning of the diamond wheel between a first and a second rotor part being depicted.

The design of diamond wheel 13 is particularly clearly apparent in FIG. 8 and FIG. 9.

In conjunction with FIGS. 10 through 13, yet another, third specific embodiment of a camshaft adjuster 1 is illustrated, camshaft adjuster 1 per se being designed and manufactured the same as camshaft adjuster 1 according to the first specific embodiment, but rotor 3 having a slightly different design. The other features of camshaft adjuster 1 mentioned above also apply to this camshaft adjuster 1. Unlike rotor 3 from the other two specific embodiments, according to this specific embodiment rotor 3 is nested radially, not axially. Rotor 3 thus essentially has the structure of an onion. As is clearly apparent in particular in FIG. 12, rotor 3 once again includes a first rotor part 4, a second rotor part 5, and a third rotor part 6. First rotor part 4 is designed as a center rotor part 4 which is situated between second rotor part 5 and third rotor part 6 in the radial direction. First rotor part 4 has a ring-shaped design, and once again rests with its first supporting surface 9, designed as an inner circumferential surface, against an outer surface of camshaft 7. This first supporting surface 9 is once again designed and manufactured/calibrated in the same way as first supporting surface 9 of the preceding specific embodiments.

Second rotor part 5 is radially accommodated/inserted within first rotor part 4, and once again is designed the same way as second supporting surface 11 (second supporting surface 11 according to the specific embodiment according to FIGS. 1 through 9) and rests against a front surface of camshaft 7. Second rotor part 5 is ring-shaped, and has an essentially square cross section. Second rotor part 5 is geometrically adjusted with regard to its width and its planarity in the area of second supporting surface 11. Third rotor part 6 is connected in a rotatably fixed manner to this first rotor part 4, radially outside same. As is clearly apparent in particular in FIGS. 11 through 13, third rotor part 6 forms a housing which accommodates the two other rotor parts 4 and 5. Vanes 10 of rotor 3 are formed solely by third rotor part 6.

In other words, camshaft adjuster 1 according to the present invention provides a rotor 3 that is made up of multiple parts (first through third rotor parts 4, 5, 6), rotor parts 4, 5, 6 being combined with one another and connected in layers. The camshaft centering (centering of camshaft 7) is provided, without cutting, in one of the rotor parts (namely, first rotor part 4) as a cylindrical through opening having the desired dimensions in a calibration process/calibration step. Rotor 3 may have a design according to the sandwich principle, made up of two to three layered parts that are joined together axially and radially by a form-fit, force-fit, or integral bond connection. At least one rotor part 4, 5, 6 has a cylindrical through recess, which for the centering on camshaft 7 is designed with appropriate properties such as diameter, width, hardness, surface roughness, etc., and manufactured without cutting by shaping and sintering with the aid of a calibration processes. The width of first rotor part 4 corresponds to the centering depth of camshaft 7 in the rotor assembly. The necessary undercuts for the camshaft edge (front side of camshaft 7) or for the fixing of diamond wheel 13 are produced, without cutting, as indentations/recesses 14 on the flange side of rotor part 4 by shaping. Alternatively, rotor 3 may also have a design according to the onion skin principle, in which the camshaft centering in the inner portion is produced, without cutting, by shaping, sintering, or calibrating. Diamond wheel 13 may be inserted between the rotor parts 4, 5 during joining in the rotor assembly, and fixed in rotor 3 with play, or also without play.

LIST OF REFERENCE NUMERALS

1 camshaft adjuster
2 stator
3 rotor
4 first rotor part
5 second rotor part
6 third rotor part
7 camshaft
8 fastening means
9 first supporting surface
10 vane
11 second supporting surface
12 fluid-conducting channel
13 diamond wheel
14 recess
15 rotation axis

What is claimed is:

1. A camshaft adjuster for an internal combustion engine of the vane cell type, the camshaft adjuster comprising:

a stator; and a rotor rotatable relative to the stator and made up of a first rotor part, a second rotor part and a third rotor part, the first, second and third rotor parts being nested together at least one of axially or radially such that the first, second and third rotor parts rotate together within the stator, the rotor being connectable in a rotatably fixed manner to a camshaft of the internal combustion engine, the first rotor part including at least one first supporting surface configured for contacting the camshaft, the at least one first supporting surface being geometrically adjusted such that a porosity of the at least one first supporting surface is lower than other surfaces of the first rotor part, a diamond wheel configured for increasing a friction force contacts the at least one first supporting surface or at least one second support surface of the second rotor part.

2. The camshaft adjuster as recited in claim 1 wherein the second rotor part supports the camshaft in an axial direction, the first rotor part being connected to the second rotor part in a rotatably fixed manner.

3. The camshaft adjuster as recited in claim 1 wherein the first, second and third rotor parts are nested axially.

4. The camshaft adjuster as recited in claim 3 wherein the first rotor part includes a first radially extending surface configured for facing axially toward the camshaft and a second radially extending surface axially abutting the second rotor part.

5. The camshaft adjuster as recited in claim 4 wherein the second rotor part includes a first radially extending surface axially abutting the second radially extending surface of the first rotor part, and the second rotor part further including a second radially extending surface axially abutting the third rotor part such that the second rotor part is sandwiched axially between the first rotor part and the third rotor part radially inside of the stator.

6. The camshaft adjuster as recited in claim 3 wherein the first, second and third rotor parts together form rotor vanes.

7. The camshaft adjuster as recited in claim 3 wherein the first and second rotor parts form radially extending channels therebetween.

8. The camshaft adjuster as recited in claim 7 wherein the second and third rotor parts form radially extending channels therebetween.

9. A camshaft adjuster for an internal combustion engine of the vane cell type, the camshaft adjuster comprising:

a stator; and a rotor rotatable relative to the stator and made up of a first rotor part, a second rotor part and a third rotor part, the first, second and third rotor parts being nested together at least one of axially or radially such that the first, second and third rotor parts rotate together within the stator, the rotor being connectable in a rotatably fixed manner to a camshaft of the internal combustion engine, the first rotor part including at least one first supporting surface configured for contacting the camshaft, the at least one first supporting surface being geometrically adjusted such that a porosity of the at least one first supporting surface is lower than other surfaces of the first rotor part, wherein the first, second and third rotor parts are nested radially, wherein the first rotor part is provided radially outside of the second rotor part, wherein a radially outer portion of the third rotor part is radially outside of the first rotor part.

10. The camshaft adjuster as recited in claim 9 wherein a radially inner portion of the third rotor part is radially inside of the first rotor part.

11. The camshaft adjuster as recited in claim 10 wherein the second rotor part axially abuts the radially inner portion of the third rotor part.

12. The camshaft adjuster as recited in claim 10 wherein the third rotor part includes an intermediate portion connecting the radially inner portion and the radially outer portion, the first rotor part being inserted within the third rotor part and axially abutting the intermediate portion.

13. A camshaft adjuster for an internal combustion engine of the vane cell type, the camshaft adjuster comprising:

a stator; and a rotor rotatable relative to the stator and made up of a first rotor part, a second rotor part and a third rotor part, the first, second and third rotor parts being nested together at least one of axially or radially such that the first, second and third rotor parts rotate together within the stator, the rotor being connectable in a rotatably fixed manner to a camshaft of the internal combustion engine, the first rotor part including at least one first supporting surface configured for contacting the camshaft, the at least one first supporting surface being geometrically adjusted such that a porosity of the at least one first supporting surface is lower than other surfaces of the first rotor part, wherein the first, second and third rotor parts are nested radially, wherein the rotor includes vanes, the vanes being formed solely by the third rotor part.

14. The camshaft adjuster as recited in claim 13 wherein the at least one first supporting surface is an inner circumferential surface of the first rotor part configured for contacting the camshaft in a radial direction.

15. The camshaft adjuster as recited in claim 13 wherein the first, second and third rotor parts are nested radially, wherein the first rotor part is provided radially outside of the second rotor part, wherein a radially outer portion of the third rotor part is radially outside of the first rotor part.

* * * * *